US008025737B2

(12) United States Patent
Watanabe et al.

(10) Patent No.: US 8,025,737 B2
(45) Date of Patent: Sep. 27, 2011

(54) SUBSTRATE CLEANING APPARATUS AND METHOD EMPLOYED THEREIN

(75) Inventors: Masaya Watanabe, Yamanashi (JP); Sakae Kobayashi, Osaka (JP); Akira Kabeshita, Yamanashi (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/003,331

(22) PCT Filed: Oct. 29, 2009

(86) PCT No.: PCT/JP2009/005738

§ 371 (c)(1),
(2), (4) Date: Jan. 10, 2011

(87) PCT Pub. No.: WO2010/050217

PCT Pub. Date: May 6, 2010

(65) Prior Publication Data

US 2011/0114117 A1 May 19, 2011

(30) Foreign Application Priority Data

Oct. 31, 2008 (JP) ..... 2008-282313
Jul. 31, 2009 (JP) ..... 2009-179099

(51) Int. Cl.
*B08B 1/00* (2006.01)

(52) U.S. Cl. ..... 134/6; 134/9; 134/15; 134/18; 134/25.4; 134/42; 134/201; 134/902; 15/97.1; 15/100; 15/102

(58) Field of Classification Search ..... 134/6, 9, 134/15, 18, 25.4, 42, 201, 902; 15/97.1, 15/100, 102
See application file for complete search history.

(56) References Cited

U.S. PATENT DOCUMENTS

| | | | | |
|---|---|---|---|---|
| 3,641,605 | A * | 2/1972 | Lindsay | 15/1.51 |
| 3,862,801 | A * | 1/1975 | Komp | 430/117.3 |
| 2009/0065029 | A1 | 3/2009 | Watanabe et al. | |

FOREIGN PATENT DOCUMENTS

| | | |
|---|---|---|
| JP | 2001-170593 | 6/2001 |
| JP | 2002-50655 | 2/2002 |
| JP | 3503512 | 12/2003 |
| JP | 2004-33970 | 2/2004 |
| JP | 4114416 | 4/2008 |
| WO | 2006/106803 | 10/2006 |

OTHER PUBLICATIONS

International Search Report issued Dec. 8, 2009 in International (PCT) Application No. PCT/JP2009/005738. Notification of Transmittal of Copies of Translation of the International Preliminary Report on Patentability issued Oct. 29, 2009 in International (PCT) Application No. PCT/JP2009/005738.

* cited by examiner

*Primary Examiner* — Sharidan Carrillo
(74) *Attorney, Agent, or Firm* — Wenderoth, Lind & Ponack, L.L.P.

(57) ABSTRACT

A substrate cleaning apparatus for cleaning a front-side clean target surface 1a and a back-side clean target surface 1b of a edge portion of a substrate 1 by wiping surfaces 12a, 12b of a cleaning tape 12. The substrate cleaning apparatus includes a presser member 11a for pressing the cleaning tape 12 against the clean target surface 1a, a presser member 11b for pressing the cleaning tape 12 against the clean target surface 1b, a tape path passing through between the presser member 11a and the clean target surface 1a and between the presser member 11b and the clean target surface 1b, a moving device for moving the cleaning tape 12 and the substrate 1 relative to each other in a longitudinal direction of the edge portion.

20 Claims, 11 Drawing Sheets

PRIOR ART

PRIOR ART

SUBSTRATE CLEANING APPARATUS AND METHOD EMPLOYED THEREIN

TECHNICAL FIELD

The present invention relates to a substrate cleaning apparatus, as well as a method therefor, for cleaning clean target surfaces which are surfaces to be cleaned and which are located on front and back side of a edge portion of a circuit substrate exemplified by glass substrates that are used in, for example, liquid crystal display devices and plasma display devices.

BACKGROUND ART

In manufacture of glass substrates, conventionally, in some cases, as shown in FIG. 13, various component parts 54 are mounted on a plurality of electrodes formed in a edge portion of a glass substrate 51. First, as shown in FIG. 13(*a*), clean target surfaces (surfaces that need to be cleaned), which are positioned on front and back sides of the edge portion of the glass substrate 51 in which the electrodes 52 are placed, are cleaned. Next, as shown in FIG. 13(*b*), an anisotropic conductive film (ACF) 53 is stuck onto the electrodes 52. Then, as shown in FIG. 13(*c*), component parts 54 are thermo-compression bonded to the electrodes 52 via the ACF 53.

A substrate cleaning apparatus for cleaning the clean target surfaces of a edge portions of a substrate is disclosed Japanese Patent No. 3503512. In this disclosed substrate cleaning apparatus, while a fabric cleaning tape is pressed against the edge portion of the substrate by a presser member, the substrate is moved in a longitudinal direction of the edge portion. As a result, the clean target surfaces of the edge portion of the substrate are cleaned by the cleaning tape.

A construction of the disclosed substrate cleaning apparatus is explained with reference to FIG. 14. The substrate cleaning apparatus has a substrate moving device 62 for moving a substrate 61, and a cleaning device for cleaning the substrate 61. The substrate moving device 62 supports a central portion of the substrate 61 from below. Also, the substrate moving device 62 is so made up as to move the substrate 61 in the longitudinal direction of its edge portion. The substrate 61 is positioned by the substrate moving device 62 in a direction perpendicular to the longitudinal direction of the edge portion of the substrate 61 with respect to a cleaning part 64 of the cleaning device 63. The cleaning device 63 has, in its cleaning part 64, presser members 65*a*, 65*b* that are to be positioned for front and back sides, respectively, of the edge portion of the substrate 61. These presser members 65*a*, 65*b* are so designed as to press a cleaning tape 66 against the front and back sides of the edge portion of the substrate 61. Before the cleaning of the edge portion of the substrate 61, the cleaning tape 66 is guided from a feeding reel 67*a* (67*b*) by a guide roller 68 so as to be moved by a specified feed amount toward between the presser member 65*a* (65*b*) and the edge portion of the substrate 61. Before move of the cleaning tape 66, a cleaner is discharged to a portion of the cleaning tape 66 which is moved to between the presser member 65*a* (65*b*) and the edge portion of the substrate 61 by the move of the cleaning tape 66. The cleaning-completed portion of the cleaning tape 66 is guided by the guide roller 68 so as to be finally wound up by a collecting roller 69*a* (69*b*). Further, the substrate cleaning apparatus is so designed as to determine, based on a color of a surface of the cleaning tape 66 to be detected by a sensor 70, that a proper amount of the cleaner has been discharged onto the cleaning tape 66.

In this substrate cleaning apparatus, however, one cleaning tape 66 is used for each of the front and back sides of the edge portion of the substrate 61. Therefore, two tape paths for the cleaning tape are provided, incurring an upsizing of the substrate cleaning apparatus. Also, only one wiping surface of the cleaning tape 66 is used for the cleaning. Therefore, the cleaning cost for the edge portion of the substrate is high.

A substrate cleaning apparatus capable of solving these problems is disclosed in Japanese Patent No. 4114416. This substrate cleaning apparatus is so designed as to clean a front-side clean target surface of the edge portion of the substrate by one wiping surface of the cleaning tape and clean a back-side clean target surface of the edge portion of the substrate by the other wiping surface. This is enabled by a 180° twist of the cleaning tape at one point on a way from the front-side clean target surface to the back-side clean target surface.

A substrate cleaning apparatus with a 180° twist of the cleaning tape independently of the above apparatus is disclosed in WO publication 2006/106803. This substrate cleaning apparatus is so designed as to clean two times either one clean target surface, front- or back-side one, of the substrate. A first-time cleaning is fulfilled by one wiping surface of the cleaning tape, and a second-time cleaning is fulfilled by the other wiping surface. For this purpose, the cleaning tape is twisted by 180°.

SUMMARY OF INVENTION

However, the substrate cleaning apparatuses disclosed in Japanese Patent No. 4114416 and WO publication 2006/106803 involve a 180 twist of the cleaning tape. This may cause a problem that the cleaning tape twists permanently or semi-permanently, and therefore the twisted cleaning tape improperly cleans the clean target surfaces. That is, there may occur cleaning failures. With occurrence of cleaning failures, the cleaning cost for the edge portion of the substrate becomes higher, naturally.

In this connection, it could be conceived to clean the individual front and back sides of the edge portion of the substrate only by one wiping surface of one cleaning tape without twisting the cleaning tape. In this case, However, the amount of cleaning tape consumption would increase, i.e., the frequency of cleaning tape replacement would increase, so that the cleaning cost would increase.

Accordingly, with a view to solving the above-described issues, an object of the present invention is to properly clean the clean target surfaces positioned on front and back sides, respectively, of the edge portion of the substrate by using two wiping surfaces of the cleaning tape without a 180° twist of the cleaning tape and moreover to suppress the cleaning cost therefor.

Also, in recent years, liquid crystal display devices and plasma display devices have been increasing in scale, as a result, glass substrates have been increasing in scale. For large-scale glass substrates, a large-scale device for moving the large-scale glass substrate in the longitudinal direction of its edge portion is needed. Therefore, moving the cleaning tape is preferred because the cleaning cost can be reduced.

For that purpose, there is a need for making up the cleaning tape, the presser member for pressing the cleaning tape against the substrate, the cleaning tape feeding device and the like into one unit, and preparing a device for moving this unit in the longitudinal direction of the edge portion of the substrate. In this case, particularly to reduce the cleaning cost, more specifically, to move the unit at a speed of 300-500 mm/s in order to shorten the cleaning time, the unit is preferably made compact. Large sizes of the unit would cause larger energy needed for start-up, acceleration, deceleration and stop of the unit.

Accordingly, a further object of the present invention is to shorten cleaning time and suppress cleaning cost for the edge portion of the substrate, particularly suppress cleaning cost for large-scale substrates, by making up a compact unit which includes cleaning tape and which is enabled to move at high speed in the longitudinal direction of the edge portion of the substrate and, in particular.

In order to achieve the above object, the present invention has the following constitutions.

According to a first aspect of the present invention, there is provided a substrate cleaning apparatus for cleaning a first clean target surface positioned on a front side of an edge portion of a substrate and a second clean target surface positioned on a back side of the edge portion of the substrate by a fabric cleaning tape including a first wiping surface and a second wiping surface, the substrate cleaning apparatus comprising:

a first presser member for pressing the cleaning tape against the first clean target surface;

a second presser member for pressing the cleaning tape against the second clean target surface;

a tape path forming member which forms a tape path for the cleaning tape, the tape path passing through between the first presser member and the first clean target surface and between the second presser member and the second clean target surface;

a tape feeding device which feeds the cleaning tape to the tape path;

a tape collecting device which collects the cleaning tape from the tape path;

a tape driving device which drives the cleaning tape;

a cleaner discharging device which discharges a cleaner to the cleaning tape; and a moving device for moving the cleaning tape and the substrate relative to each other in a longitudinal direction of the edge portion of the substrate, wherein the tape path includes:

a first path which allows the cleaning tape to pass through between the first presser member and the first clean target surface in a direction orthogonal to the longitudinal direction of the edge portion of the substrate with the first wiping surface facing the first clean target surface;

a second path which allows the cleaning tape, which has passed through the first path, to be looped so that the second wiping surface faces the back side of the substrate; and a third path which allows the cleaning tape, which has passed through the second path, to pass through between the second presser member and the second clean target surface in a direction identical to the passage direction of the cleaning tape in the first path with the second wiping surface facing the second clean target surface.

According to a second aspect of the present invention, there is provided a substrate cleaning apparatus for cleaning a first clean target surface positioned on a front side of an edge portion of a substrate and a second clean target surface positioned on a back side of the edge portion of the substrate by a fabric cleaning tape including a first wiping surface and a second wiping surface, the substrate cleaning apparatus comprising:

a first presser member for pressing the cleaning tape against the first clean target surface;

a second presser member for pressing the cleaning tape against the second clean target surface;

a tape path forming member which forms a tape path for the cleaning tape, the tape path passing through between the first presser member and the first clean target surface and between the second presser member and the second clean target surface;

a tape feeding device which feeds the cleaning tape to the tape path;

a tape collecting device which collects the cleaning tape from the tape path;

a tape driving device which drives the cleaning tape;

a cleaner discharging device which discharges a cleaner to the cleaning tape; and a moving device for moving the cleaning tape and the substrate relative to each other in a longitudinal direction of the edge portion of the substrate, wherein the tape path includes:

a first path which allows the cleaning tape to pass through between the first presser member and the first clean target surface in a direction orthogonal to the longitudinal direction of the edge portion of the substrate with the first wiping surface facing the first clean target surface;

a second path which allows the cleaning tape, which has passed through the first path, to be looped so that the second wiping surface faces the back side of the substrate; and a third path which allows the cleaning tape, which has passed through the second path, to pass through between the second presser member and the second clean target surface with the second wiping surface facing the second clean target surface, and wherein the tape feeding device has a feeding reel on which the cleaning tape is wound, the tape collecting device has a collecting reel for winding up and collecting the cleaning tape, and the feeding reel and the collecting reel are juxtaposed in parallel.

According to a third aspect of the present invention, there is provided the substrate cleaning apparatus according to the second aspect, wherein the third path is so formed that the tape path forming member allows the cleaning tape to pass through in a direction identical to the passage direction of the cleaning tape in the first path.

According to a fourth aspect of the present invention, there is provided the substrate cleaning apparatus according to any one of the first, second, and third aspects, wherein the tape path forming member forms the tape path so as to further include a fourth or fifth path, the fourth path which allows the cleaning tape, which has passed through the third path, to bypass the second path by passing beside a widthwise direction of the cleaning tape of the second path, and to reach the tape collecting device, the fifth path which allows the cleaning tape, which has passed from the tape feeding device, to bypass the second path by passing beside the widthwise direction of the cleaning tape of the second path, and to reach the first path.

According to a fifth aspect of the present invention, there is provided the substrate cleaning apparatus according to any one of the first, second, and third aspects, further comprising:

a cleaning unit which includes at least a tape feeding device, first and second presser members, and a tape path forming member, and which is removably fitted to a main body of the substrate cleaning apparatus; and a driving device for driving the tape feeding device, and a driving device for driving the first and second presser members, the driving devices being provided on the main body of the substrate cleaning apparatus.

According to a sixth aspect of the present invention, there is provided the substrate cleaning apparatus according to any one of the first, second, and third aspects, wherein the second path is formed by the tape path forming member so that the cleaning tape is looped along a periphery of the tape feeding device.

According to a seventh aspect of the present invention, there is provided the substrate cleaning apparatus according to any one of the first, second, and third aspects, wherein the first path is formed by the tape path forming member so that the cleaning tape passes through between the first presser member and the first clean target surface in a direction increasingly away from the tape feeding device, the second path is formed by the tape path forming member so that the cleaning tape that has passed through the first path is looped along the periphery of the tape feeding device, and the third path is formed by the tape path forming member so that the cleaning tape passes in a direction identical to the passage direction of the cleaning tape in the first path.

According to a eighth aspect of the present invention, there is provided the substrate cleaning apparatus according to any one of the first, second, and third aspects, further comprising:

a control device for controlling a feed amount of the cleaning tape by the tape driving device; and a surface contamination detecting device for detecting a surface contamination of the second wiping surface of the cleaning tape after passing through between the first presser member and the first clean target surface, wherein the control device controls the feed amount of the cleaning tape so that a part of the second wiping surface where more than a prescribed level of surface contamination has been detected by the surface contamination detecting device skips between the second presser member and the second clean target surface.

According to a ninth aspect of the present invention, there is provided the substrate cleaning apparatus according to the eighth aspect, wherein an alarm is issued when skip execution frequency by the control device becomes a prescribed frequency or more.

According to a tenth aspect of the present invention, there is provided a substrate cleaning method for cleaning a first clean target surface positioned on a front side of an edge portion of a substrate and a second clean target surface positioned on a back side of the edge portion of the substrate by a fabric cleaning tape which includes a first wiping surface and a second wiping surface and which is impregnated with a cleaner, the substrate cleaning method comprising:

cleaning the first and second clean target surfaces by moving the cleaning tape and the substrate relative to each other in a longitudinal direction of the edge portion of the substrate while the cleaning tape is pressed against the first clean target surface by the first presser member and moreover the cleaning tape is pressed against the second clean target surface by the second presser member; and driving the cleaning tape in such a way that:

the cleaning tape passes through between the first presser member and the first clean target surface in a direction orthogonal to the longitudinal direction of the edge portion of the substrate with the first wiping surface facing the first clean target surface of the substrate, next, the cleaning tape is looped so that the second wiping surface faces the back side of the substrate; and subsequently, the cleaning tape passes through between the second presser member and the second clean target surface in a direction identical to the passage direction of the cleaning tape between the first presser member and the first clean target surface with the second wiping surface facing the second clean target surface.

According to a eleventh aspect of the present invention, there is provided a substrate cleaning apparatus for cleaning a first clean target surface positioned on a front side of an edge portion of a substrate and a second clean target surface positioned on a back side of the edge portion of the substrate by a fabric cleaning tape including a first wiping surface and a second wiping surface, the substrate cleaning apparatus comprising:

(1) a cleaning unit including;

a first presser member for pressing the cleaning tape against the first clean target surface;

a second presser member for pressing the cleaning tape against the second clean target surface;

a tape path forming member which forms a tape path for the cleaning tape, the tape path passing through between the first presser member and the first clean target surface and between the second presser member and the second clean target surface;

a tape feeding device which feeds the cleaning tape to the tape path;

a tape collecting device which collects the cleaning tape from the tape path;

a tape driving device which drives the cleaning tape; and a cleaner discharging device which discharges a cleaner to the cleaning tape; and (2) a cleaning unit moving device which moves the cleaning unit in a longitudinal direction of the edge portion of the substrate, wherein the tape feeding device has a feeding reel on which the cleaning tape is wound up, the tape collecting device has a collecting reel for winding up and collecting the cleaning tape, and the feeding reel and the collecting reel are juxtaposed in parallel.

According to a twelfth aspect of the present invention, there is provided the substrate cleaning apparatus according to the eleventh aspect, wherein the cleaning unit moving device is so designed as to move the cleaning unit removably fitted thereon.

According to the present invention, by using two wiping surfaces of the cleaning tape without twisting the cleaning tape to 180°, clean target surfaces positioned on front and back sides of the edge portion of the substrate can be properly cleaned and moreover the cleaning cost therefor can be suppressed.

Also according to the present invention, by a feeding reel and a collecting reel included in a parallel state, there can be provided a cleaning unit which is made compact and which is enabled to move at high speed. By this cleaning unit, the cleaning time can be shortened and the cleaning cost for the edge portion of the substrate can be suppressed. Also, for large-scale substrates, the cleaning cost can be further suppressed by shortening of the cleaning time and by the elimination of the need for any large-scale device for moving the large-scale substrate in the longitudinal direction of its edge portion.

BRIEF DESCRIPTION OF DRAWINGS

FIG. 3(*b*) is side view of a cleaning part of the substrate cleaning apparatus;

FIG. 12(*b*) is a schematic perspective view of a modification of the substrate cleaning apparatus according to the fourth embodiment of the invention;

DESCRIPTION OF EMBODIMENTS

Figure 1:
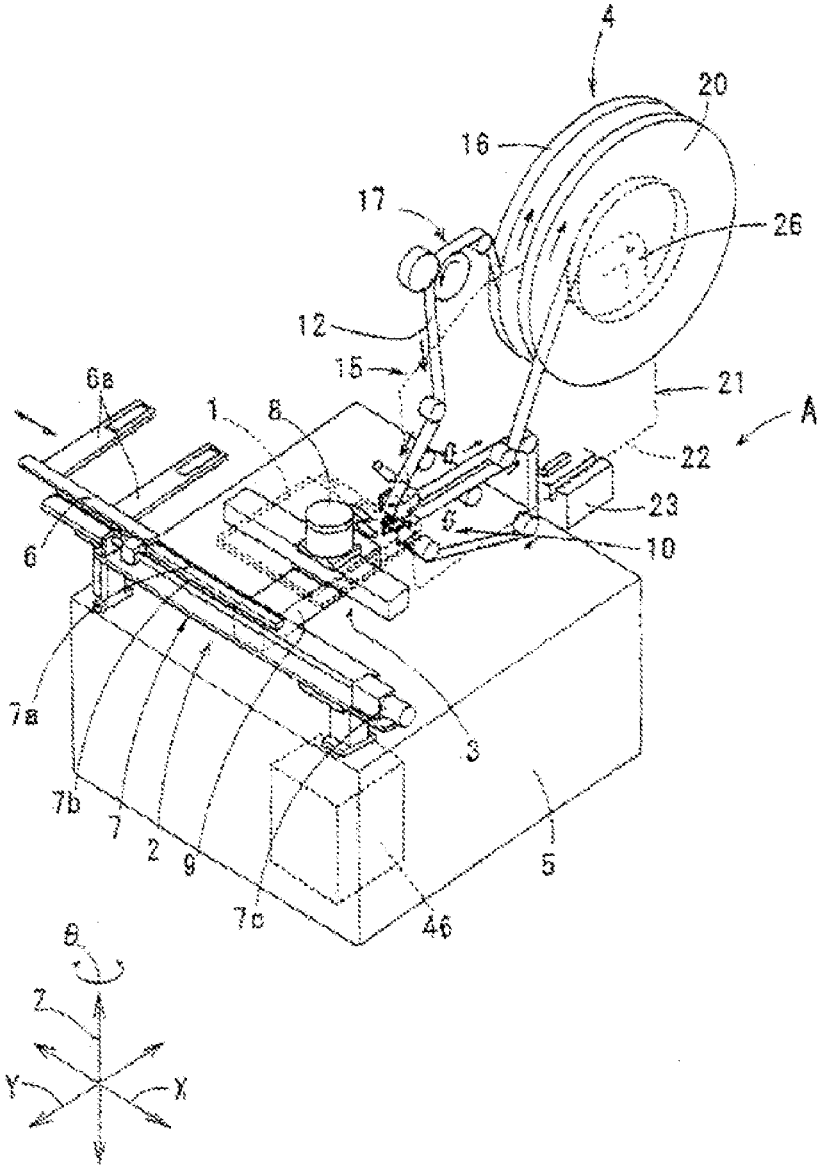
FIG. 1 is a schematic perspective view of a substrate cleaning apparatus according to a first embodiment of the present invention.

Hereinbelow, a substrate cleaning apparatus for cleaning clean target surfaces positioned on front and back sides, respectively, of the edge portion of a glass substrate in a liquid crystal display device will be described with reference to FIGS. 1 to 12.

First Embodiment

First, a substrate cleaning apparatus according to a first embodiment of the invention is described with reference to FIGS. 1 to 8. The substrate cleaning apparatus shown in FIG. 1 includes a substrate conveying device 2 for carrying a substrate 1 into the substrate cleaning apparatus, a substrate moving device 3 for moving the substrate 1 received from the substrate conveying device 2, and a cleaning mechanism 4 for cleaning clean target surfaces 1*a*, 1*b* (surfaces that need to be cleaned) positioned on front and back sides, respectively, of the edge portion of the substrate 1 (see FIGS. 4 and 5). These members are provided on a base 5. In addition, by a substrate conveying device (not shown) which is similar to the substrate conveying device 2 and which is provided in an ACF sticking apparatus (not shown), the cleaning-completed substrate 1 is carried out from the substrate cleaning apparatus and carried into the ACF sticking apparatus.

The substrate conveying device 2 has a fork 6 including a pair of support arms 6*a*, 6*b* on which the substrate 1 is to be placed, and a drive mechanism 7 for moving the fork 6 in a substrate conveyance direction (X direction). The drive mechanism 7 has a rail 7*a* for guiding the fork 6, and a feed screw mechanism 7*b* which is driven by a motor 7*c* to move the fork 6.

The substrate moving device 3 has a substrate holding mechanism 8 for holding a substantial center of the substrate 1, and a moving/rotating table 9 for translating the substrate holding mechanism 8 in an X-axis direction and a Y-axis direction orthogonal to the X-axis direction and rotating the substrate holding mechanism 8 about a Z-axis direction. Before start of the cleaning, the substrate moving device 3 performs positioning of longitudinal (X-axis direction) one end of the clean target surfaces positioned on front and back sides of the edge portion of the substrate 1 by the moving/rotating table 9. During the cleaning, the substrate moving device 3 moves the substrate 1 in the longitudinal direction of its edge portion of the substrate by the moving/rotating table 9. As a result, the cleaning part 10 of the cleaning mechanism 4 fulfills cleaning of the clean target surface from its one end to the other end.

The cleaning part 10 of the cleaning mechanism 4 has presser members 11*a*, 11*b* (first and second presser members) as shown in FIGS. 2 to 5. The presser member 11*a* is opposed to the front-side clean target surface 1*a* of the edge portion of the substrate 1 held by the substrate holding mechanism 8, while the presser member 11*b* is opposed to the back-side clean target surface 1*b*. The presser member 11*a* is designed to press cleaning tape 12 against the clean target surface 1*a*. The presser member 11*b* is designed to press the cleaning tape 12 against the clean target surface 1*b*. In addition, an electrode t of the substrate 1 is provided in the front-side clean target surface 1*a* of the substrate 1 (see FIG. 4). Each of the presser members 11*a*, 11*b* has a protrusion 13*a* which is provided in a counter surface (surface to make contact with the cleaning tape 12) 13 opposed to the substrate 1 and which extends in a direction (Y-axis direction) orthogonal to the longitudinal direction of the edge portion of the substrate 1 (see FIG. 4). When the substrate 1 is moved in the longitudinal direction (X-axis direction) of the edge portion, the protrusion 13*a* is designed to make the cleaning tape 12 engaged therewith so that the cleaning tape 12 is prevented from being moved in the longitudinal direction along with the substrate 1. Also, each of the presser members 11*a*, 11*b* has a sloped guide surface 14 for guiding the cleaning tape 12 to the counter surface 13.

Preferably, the presser members 11*a*, 11*b* are made from such a material as polyacetal (POM) excellent in chemical resistance and slidability.

A cleaning tape feeding mechanism 15 is a mechanism for intermittently moving the cleaning tape 12 to between the presser member 11*a* and the clean target surface 1*a* as well as to between the presser member 11*b* and the clean target surface 1*b*. The cleaning tape feeding mechanism 15 is also a mechanism for feeding the cleaning tape 12 from the feeding reel 16 on which the cleaning tape 12 is wound thereon and which is one part of devices for feeding the cleaning tape 12, to the collecting reel 20 which is one part of devices for collecting the cleaning tape 12 and which winds up and collects the cleaning tape 12. The cleaning tape feeding mechanism 15 is designed to feed the cleaning tape 12 in a direction orthogonal to the longitudinal direction of the edge portion of the substrate 1.

The cleaning tape feeding mechanism 15 has a cleaning tape driving device 17. The cleaning tape driving device 17 has a drive roller 17*a* for driving the cleaning tape 12, and a pinch roller 17*b* for pressing the cleaning tape 12 against the drive roller 17*a*. Before start of cleaning, the cleaning tape driving device 17 pulls out the cleaning tape 12 from the feeding reel 16, and moves the cleaning tape 12 to a specified move amount (feed amount).

The cleaning tape feeding mechanism 15 also has a tape path forming member 18 for forming a tape path for the cleaning tape 12, the tape path passing from the feeding reel 16 through between the presser member 11*a* and the clean target surface 1*a* and between the presser member 11*b* and the clean target surface 1*b* to reach the collecting reel 20. The tape path forming member 18 is made up of a plurality of guide rollers 18*a*-18*h*.

Figure 2:
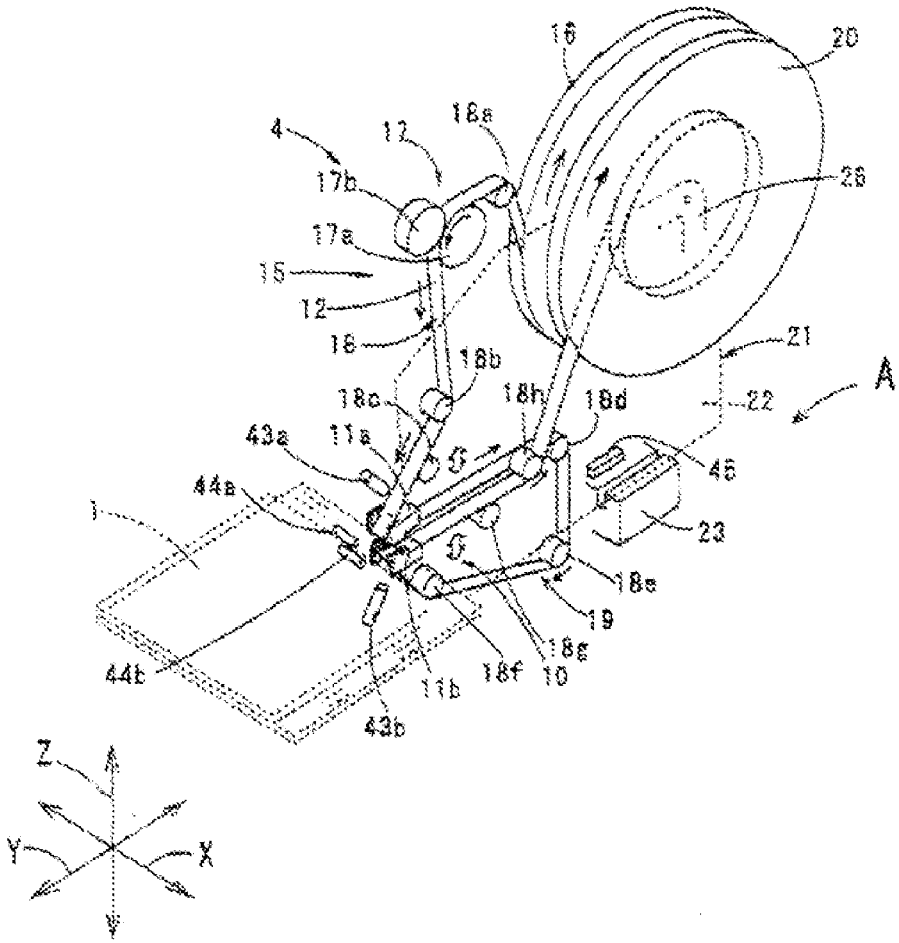
FIG. 2 is a partly enlarged view of FIG. 1.
Figure 3:
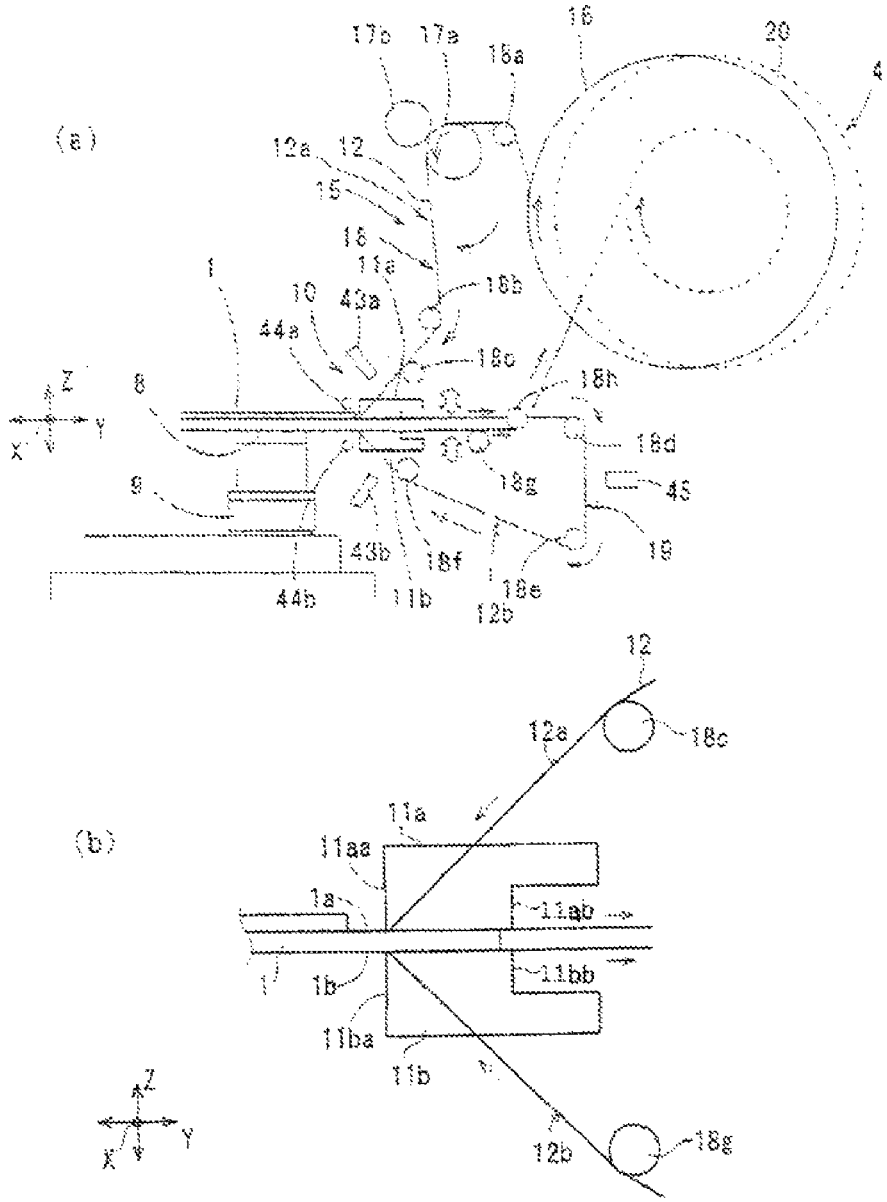
FIG. 3(*a*) is a schematic side view of the substrate cleaning apparatus according to the embodiment.

The tape path forming member 18, as shown in FIG. 3(*b*), forms a path (first path) that allows the cleaning tape 12 to pass through between the presser member 11*a* and the clean target surface 1*a* from a substrate-center side end 11*aa* to a counter-substrate-center side end 11*ab* of the presser member 11*a* with one wiping surface 12*a* (first wiping surface) facing the front-side clean target surface la of the edge portion of the substrate 1. Also, the tape path forming member 18, as shown in FIG. 2, forms a loop path 19 (second path) that allows the cleaning tape 12 (more strictly, part of the cleaning tape 12), which has passed completely through between the presser member 11*a* and the clean target surface 1*a*, to loop so that the other wiping surface 12*b* faces the back side of the substrate 1. Further, the tape path forming member 18 forms a path (third path) that allows the loop-completed cleaning tape (more strictly, part of the cleaning tape 12) to pass through between the presser member 11*b* and the clean target surface 1*b* in a direction from a substrate-center side end 11*ba* to a counter-substrate-center side end 11*bb* of the presser member 11*b* with the wiping surface 12*b* facing the clean target surface 1*b*.

The cleaning tape 12 (more strictly, part of the cleaning tape 12) that has passed through between the presser member 11*b* and the clean target surface 1*b* finally reaches the collecting reel 20.

In addition, in a case where the loop path 19 is present on a line extending from between the presser member 11*b* and the clean target surface 1*b* to the collecting reel 20, the tape path forming member 18 forms a path (fourth path) that passes from between the presser member 11*b* and the clean target surface 1*b*, bypasses the loop path 19 by passing beside the widthwise direction of the cleaning tape of the loop path 19, and reach the collecting reel 20. As a result of this, crossing among the tape paths for the cleaning tape 12 can be avoided.

Alternatively, in a case where the loop path 19 is present on a line extending from the feeding reel 16 to between the presser member 11*a* and the clean target surface 1*a*, the tape path forming member 18 forms a path (fifth path) that passes from the feeding reel 16, bypasses the loop path 19 by passing beside the cleaning-tape widthwise direction of the loop path 19, and reach to between the presser member 11*a* and the clean target surface 1*a*. As a result of this, crossing among the tape paths for the cleaning tape 12 can be avoided.

Figure 7:
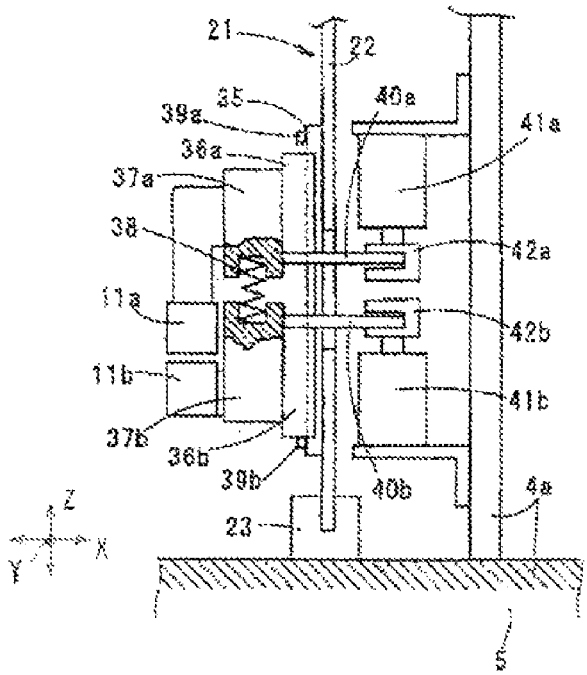
FIG. 7 is a schematic view of a drive mechanism for driving presser members in the embodiment.

In this embodiment, the feeding reel 16, the cleaning tape driving device 17, the presser members 11*a*, 11*b*, the tape path forming member 18 (plural guide rollers 18*a*-18*h*), and the collecting reel 20 are provided in a unit frame 22 to make up one cleaning unit 21. This cleaning unit 21, as shown in FIG. 7 taken along an arrow A of FIG. 1 or 2, is designed so as to be removably fitted (designed like a cassette) on a main body 4*a* of the cleaning mechanism 4 provided on the base 5. Therefore, as shown in FIGS. 1, 2 and 7, the main body 4*a* includes a unit fixing member 23 for holding the unit frame 22 to fix the cleaning unit 21 at a specified position on the main body 4*a*. The feeding reel 16 and the collecting reel 20 are provided in parallel so that their rotational center lines become substantially coincident with each other.

The terms "rotational center lines become substantially coincident with each other" herein mean that rotational center lines of the feeding reel 16 and the collecting reel 20 are on one straight line or parallel to each other with a distance therebetween smaller than a radius of one reel. It is noted that the terms are not limited to the supporting of the two reels 16, 20 by one common shaft. Also, the terms are not limited to the sameness of rotational direction of the two reels 16, 20.

Figure 6:
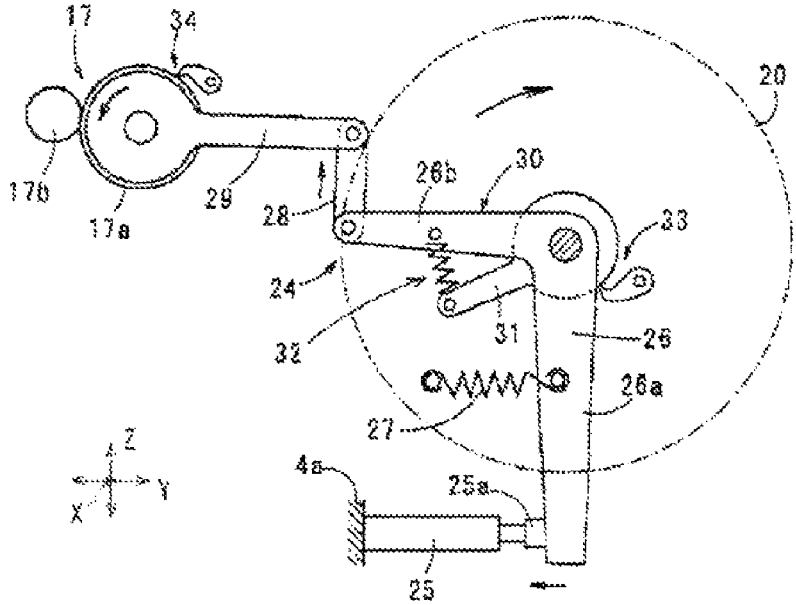
FIG. 6 is a schematic view of an interlocking mechanism for synchronizing a cleaning tape driving device and a collecting reel with each other in the embodiment.

The cleaning unit 21, as shown in FIG. 6, has an interlocking mechanism 24 for synchronously operating the cleaning tape driving device 17 and the collecting reel 20. This interlocking mechanism 24 is driven by a drive cylinder 25 provided on the main body 4*a* of the cleaning mechanism 4.

The interlocking mechanism 24 has a link mechanism 30 including an L-shaped swinging lever 26 having a vertical arm 26*a* and a horizontal arm 26*b*. The swinging lever 26 is incorporated into the link mechanism 30 so as to be freely swingable about the rotational center line of the collecting reel 20. This swinging lever 26 is swung by a forward end of the vertical arm 26*a* moved by the drive cylinder 25. Also, a spring 27 for biasing the forward end of the vertical arm 26*a* toward a forward end 25*a* of a piston rod is incorporated in the link mechanism 30. Contact between the forward end of the vertical arm 26*a* and the forward end 25*a* of the piston rod is maintained by the spring 27. The horizontal arm 26*b* of the swinging lever 26 is coupled at its forward end to a forward end of the feed arm 29 via a link 28. This feed arm 29 is incorporated in the link mechanism 30 so as to be freely swingable about the rotational center line of the drive roller 17*a* of the cleaning tape driving device 17.

The link mechanism 30 also has a collect arm 31. The collect arm 31 is incorporated in the link mechanism 30 so as to be freely swingable about the rotational center line of the collecting reel 20. Also, the collect arm 31 is coupled at its forward end to the horizontal arm 26*b* of the swinging lever 26 via a spring 32. Further, the collect arm 31 is coupled to the collecting reel 20 via a ratchet mechanism 33. Similarly, the feed arm 29 is coupled to the drive roller 17*a* via a ratchet mechanism 34.

Operation of the interlocking mechanism 24 is now described with reference to FIG. 6.

Before start of cleaning, the piston rod of the drive cylinder 25 is moved forward, so that the swinging lever 26 is swung counterclockwise.

After completion of the forward move of the piston rod, the piston rod is moved backward or set free. As a result of this, the swinging lever 26 is pulled by the spring 27 so as to be swung clockwise. With the swinging lever 26 swung clockwise, the collect arm 31 is swung clockwise via the spring 32. By the clockwise swinging of the collect arm 31, the collecting reel 20 is rotated via the ratchet mechanism 33. Then, the collecting reel 20 winds up the cleaning tape 12 by an amount corresponding to the clockwise swinging amount of the swinging lever 26.

As the swinging lever 26 is swung clockwise, the feed arm 29 is swung counterclockwise via the link 28. As the feed arm 29 is swung counterclockwise, the drive roller 17*a* is rotated counterclockwise via the ratchet mechanism 33. Then, the drive roller 17*a* moves the cleaning tape 12, which is pinched by cooperation with the pinch roller 17*b*, to an amount corresponding to the clockwise swinging amount of the swinging lever 26.

As shown in FIG. 7, the presser members 11*a*, 11*b* are fixed via mounting blocks 37*a*, 37*b* to movers 36*a*, 36*b* which are freely movable in the Z-axis direction along a guide rail 35 provided in the unit frame 22. Also, a spring 38 is set between the mounting blocks 37*a*, 37*b*. Further provided are stoppers 39*a*, 39*b* which prevent the movers 36*a*, 36*b* from dropping from the guide rail 35.

The movers 36*a*, 36*b* have operating levers 40*a*, 40*b* which extend through the unit frame 22. These movers 36*a*, 36*b* are driven by forward ends of the operating levers 40*a*, 40*b* being operated by forward ends 42*a*, 42*b* of piston rods of drive cylinders 41*a*, 41*b* provided in the main body 4*a* of the cleaning mechanism 4.

Through operation of the operating levers 40*a*, 40*b* by the drive cylinders 41*a*, 41*b*, a force with which the presser member 11*a* presses the cleaning tape 12 against the clean target surface 1*a* and a force with which the presser member 11*b* presses the cleaning tape 12 against the clean target surface 1*b* are adjusted. As the drive cylinders 41*a*, 41*b* are controlled by identical control, the force with which the presser member 11*a* presses the clean target surface 1*a* via the cleaning tape 12 and the force with which the presser member 11*b* presses the clean target surface 1*b* via the cleaning tape 12 become equal to each other. While such a state of equal pressing force is maintained, the substrate 1 is moved in the longitudinal direction of the substrate edge portion by the substrate moving device 3, by which the clean target surfaces 1*a*, 1*b* are equally cleaned by the cleaning tape 12. By the drive cylinders 41*a*, 41*b* and the spring 38, the presser members 11*a*, 11*b* can be maintained preferably in contact with the edge portion of the substrate 1 via the cleaning tape 12 during the move in the longitudinal direction of the edge portion of the substrate 1.

Figure 4:
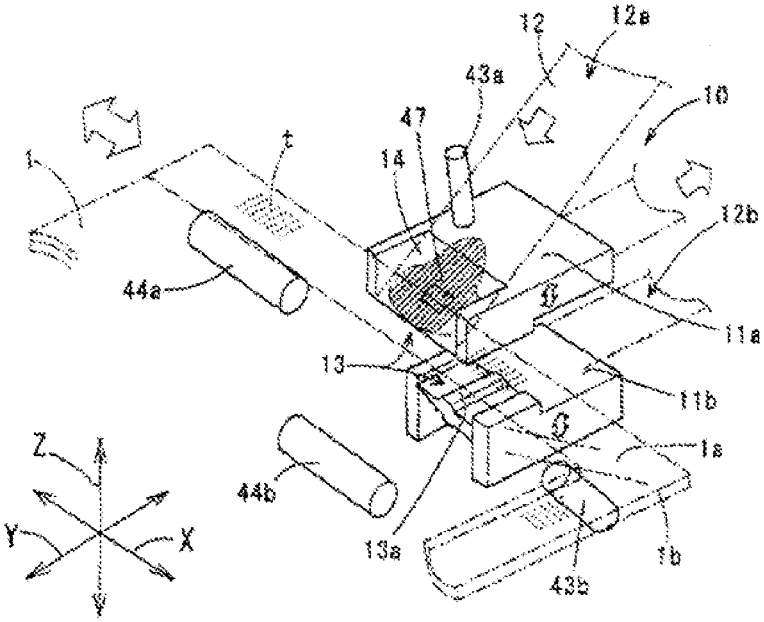
FIG. 4 is a perspective view of the cleaning part in the embodiment.

As shown in FIGS. 2 to 4, a cleaner discharge nozzles 43*a*, 43*b* are provided for discharging a volatile cleaner such as ethanol or isopropyl alcohol to part of the cleaning tape 12 on the upstream side of the guide surface of the presser members 11*a*, 11*b*. The cleaner is fed from a tank (not shown) via a pipe (not shown) to the cleaner discharge nozzles 43*a*, 43*b* by a pump immediately before move of the cleaning tape 12, and discharged from the cleaner discharge nozzles 43*a*, 43*b* toward the cleaning tape 12. The part 47 of the cleaning tape 12 where the cleaner has been discharged changes in color. Color detection sensors 44*a*, 44*b* for detecting the color of the cleaning tape 12 are provided at positions where the color of the part 47 of the cleaning tape 12 to which the cleaner has been discharged can be detected.

Also, as shown in FIG. 2 and FIG. 3(*a*), a surface contamination detection sensor 45 for detecting a surface contamination of the cleaning tape 12 is placed between guide rollers 18*d* and 18*e* that form the loop path 19. That is, the surface contamination detection sensor 45 detects the surface contamination of the wiping surface 12*b* of the cleaning tape 12 after passing through between the presser member 11*a* and the clean target surface 1*a* of the substrate 1 and before passing through between the presser member 11*b* and the clean target surface 1*b*.

A control device 46 is placed in the base 5. The control device 46 is designed to control the substrate conveying device 2, the substrate moving device 3, the drive cylinders 25, 41*a*, 41*b* of the cleaning mechanism 4, and the cleaner pump (not shown).

The control device 46 checks a discharge amount of the cleaner to the cleaning tape 12 based on detection signals of the color detection sensors 44*a*, 44*b*. Then, based on a checking result, the control device 46 controls the pump (not shown), by which the cleaner discharge amount is adjusted.

Based on a detection signal of the surface contamination detection sensor 45, the control device 46 decides whether or not a surface contamination of the cleaning tape 12 is more than a specified level of surface contamination. If the surface contamination is more than the specified level, the control device 46 controls the drive cylinder 25 so that the part of the wiping surface 12*b* of the cleaning tape 12 where a more than specified level of surface contamination has been detected skips between the presser member 11*b* and the clean target surface 1*b*. Further, the control device 46 is designed to notify of an alarm when the frequency of skip execution (e.g., number of times of skip execution per prescribed time) has surpassed a prescribed frequency.

Figure 8:
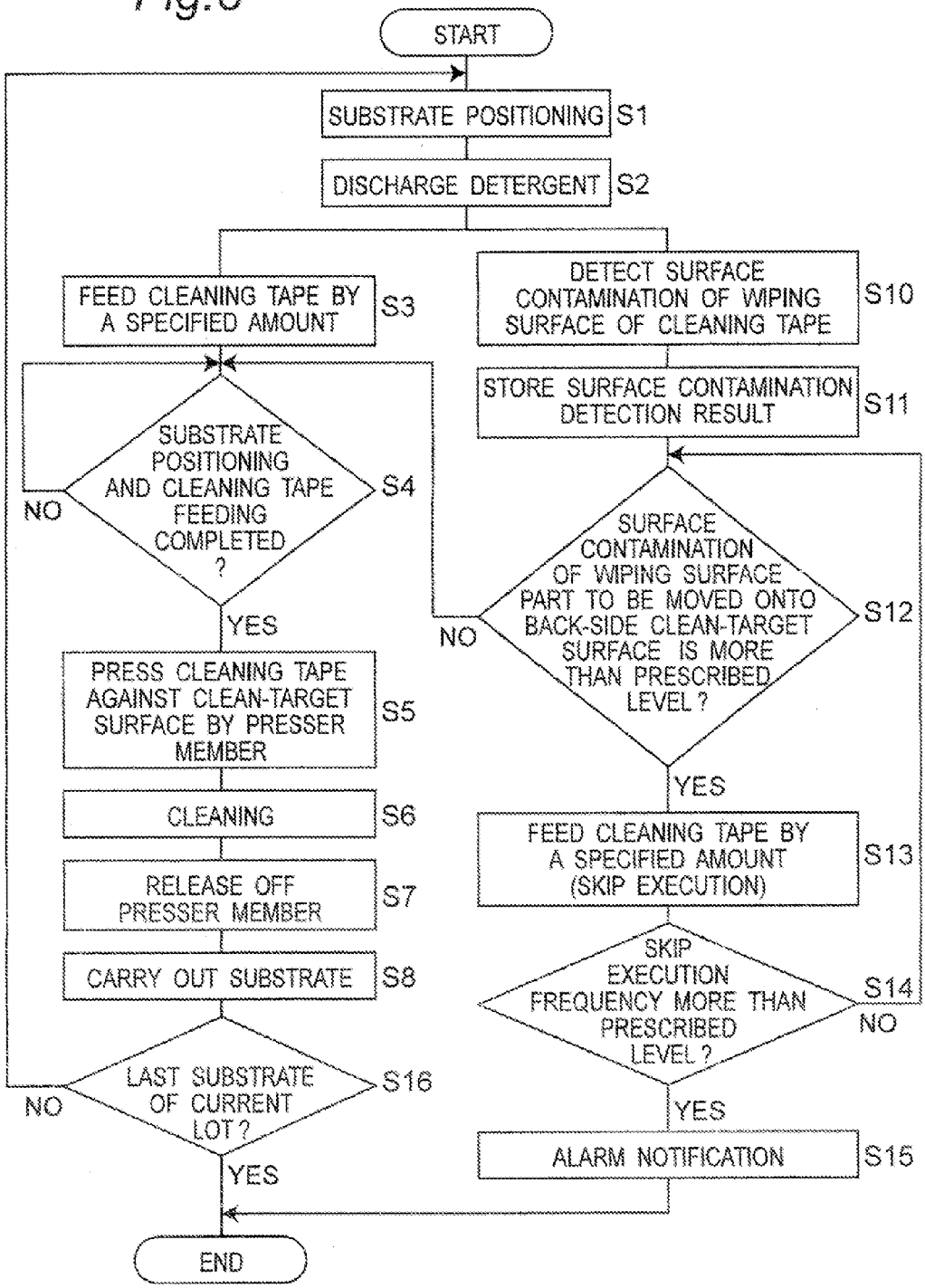
FIG. 8 is a view showing the flow of substrate cleaning in the embodiment.

From this point on, the flow of cleaning of the clean target surfaces positioned on front and back sides of the edge portion of the substrate 1 by the substrate cleaning apparatus will be described with reference mainly to FIG. 8 and subordinately to FIGS. 1 to 5.

First, the substrate 1 is carried into the substrate cleaning apparatus by the substrate conveying device 2, and set on the substrate holding mechanism 8 of the substrate moving device 3. Then, by the substrate moving device 3, a edge portion (one longitudinal end of the clean target surface) of the substrate 1 is positioned between the presser members 11*a*, 11*b* (step S1). In this operation, the presser members 11*a*, 11*b* are separate from each other by a distance surpassing the thickness of the side edge portion of the substrate 1.

The cleaner is discharged by a specified amount from the cleaner discharge nozzles 43*a*, 43*b* to the cleaning tape 12 (step S2). In addition, after the discharge of the cleaner, a part 47 of the cleaning tape 12 to which the cleaner has been discharged is detected by the color detection sensors 44*a*, 44*b*, by which it is confirmed that a specified amount of cleaner has been discharged to the cleaning tape 12.

The cleaning tape 12 is moved by a specified feed amount by the drive cylinder 25. As a result, the cleaner-discharged part of the cleaning tape 12 is placed between the presser member 11*a* and the clean target surface 1*a* as well as between the presser member 11*b* and the clean target surface 1*b* (step S3).

It is confirmed that positioning of the substrate and move of the cleaning tape 12 have been completed (step S4).

Figure 5:
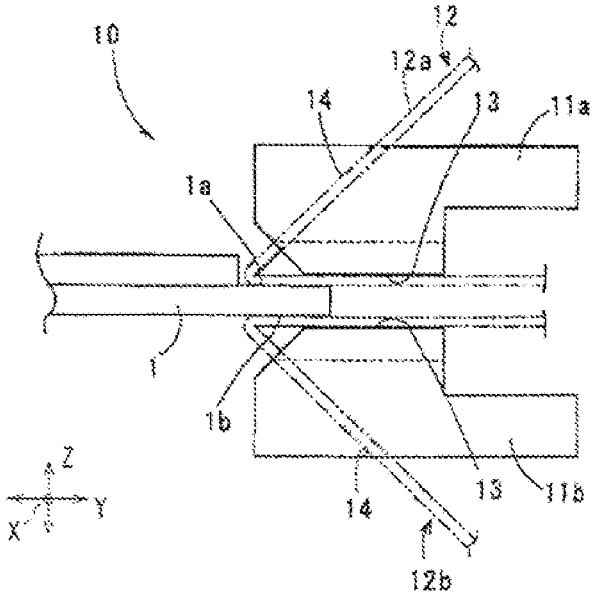
FIG. 5 is a side view of the cleaning part in the embodiment.

By the drive cylinders 41*a*, 41*b*, as shown in FIG. 5, the presser members 11*a*, 11*b* are made to press the cleaning tape 12 against the edge portion of the substrate 1. As a result, the wiping surface 12*a* of the cleaning tape 12 is maintained in contact with the front-side clean target surface 1*a* of the edge portion of the substrate 1, while the wiping surface 12*b* is maintained in contact with the back-side clean target surface 1*b* (step S5).

By the substrate moving device 3, the substrate 1 is moved in the longitudinal direction of its edge portion. As a result, the wiping surface 12*a* of the cleaning tape 12 cleans the clean target surface 1*a* from one end to the other end of the clean target surface 1*a* positioned on the front side of the edge portion of the substrate 1. Simultaneously with this, the wiping surface 12*b* of the cleaning tape 12 cleans the clean target surface 1*b* from one end to the other end of the clean target surface 1*b* positioned on the back side of the edge portion of the substrate 1 (step S6). It is noted that the clean target surfaces 1*a*, 1*b* of the edge portion of the substrate 1 may be cleaned by one-time reciprocating of the substrate 1 in the longitudinal direction.

After completion of the cleaning, the presser members 11*a*, 11*b* are moved by the drive cylinders 41*a*, 41*b* so as to be going away from the substrate 1 (step S7).

By the substrate moving device 3, the substrate 1 is moved so that the edge portion of the substrate 1 comes out from between the presser members 11*a*, 11*b*. Then, by a substrate conveying device (not shown) of the ACF sticking apparatus, the substrate 1 is carried out from the substrate cleaning apparatus (step S8).

It is checked whether or not the substrate 1 carried out by the substrate conveying device (not shown) of the ACF sticking device is the last substrate within the lot (step S16). If the substrate is the last substrate, then the program comes to an end; if not, the program returns to step S1.

In addition, in a case where a plurality of edge portions that need to be cleaned are present in the substrate 1 (e.g., the substrate is rectangular-shaped with four edge portions needing to be cleaned), whether or not all the edge portions have been completely cleaned is checked before the execution of step S16. If the cleaning is completed, the program goes to step S16; if not, an un-cleaned edge portion is positioned between the presser members 11*a*, 11*b* by the substrate moving device 3, followed by a return to step S2.

Before the start or after the completion of a specified amount of move of the cleaning tape (immediately before the start or after the completion of step S3), surface contamination of the wiping surface 12*b* of the cleaning tape 12 is detected by the surface contamination detection sensor 45 (step S10).

Data of the surface contamination detection result by the surface contamination detection sensor 45 is stored into a storage device (not shown) (step S11). In this storage device, surface contamination detection result data as to a plurality of portions (plural portions segmented by specified feed amount intervals) of the cleaning tape 12, respectively, are stored.

Before the specified feed amount move of the cleaning tape 12 (before start of step S3), and after the execution of the specified feed amount move of the cleaning tape 12, whether or not surface contamination is more than specified level is decided as to a portion of the cleaning tape 12 positioned between the presser member 11*b* and the clean target surface 1*b* (step S12). This decision is performed based on surface contamination detection result data as to each of the plurality of portions of the cleaning tape 12 stored in the storage device.

After the specified feed amount of move of the cleaning tape 12, if the surface contamination of the portion of the cleaning tape 12 positioned between the presser member 11*b* and the clean target surface 1*b* is not more than the specified level, the program goes to step S4.

Meanwhile, after the specified feed amount of move of the cleaning tape 12 (after execution of step S3), if the surface contamination of the portion of the cleaning tape 12 positioned between the presser member 11*b* and the clean target surface 1*b* is more than the specified level, then the cleaning tape 12 is moved by a specified amount by the drive cylinder 25 (step S13). As a result, after the execution of step S3, the portion of the cleaning tape 12 having surface contamination more than the specified level is not positioned between the presser member 11*b* and the clean target surface 1*b* (as a result, the portion of the cleaning tape 12 having more than the specified level of surface contamination skips between the presser member 11*b* and the clean target surface 1*b*).

Whether or not the skip execution frequency is more than a prescribed frequency (e.g., number of skip execution per prescribed time) is decided (step S14). If the skip execution frequency is not more than the prescribed frequency, the program returns to step S12. Meanwhile, if the skip execution frequency is more than the prescribed frequency, an alarm is notified (step S15). By this alarm notification, the worker is enabled to know occurrence of any trouble with the cleaning tape 12. For example, the worker can know occurrence of a trouble that the cleaner is excessively discharged (a trouble that excess cleaner discharged onto the wiping surface 12*a* appears on the counter-side wiping surface 12*b*, and the appearing cleaner is detected as surface contamination). Also the worker can know occurrence of a trouble that the clean target surface 1*a* of the substrate 1 before start of the cleaning of the substrate 1 is with surface contamination more than usual.

According to this embodiment, the cleaning tape 12 passes through between the presser member 11*a* and the clean target surface 1*a* in a direction orthogonal to the longitudinal direction of the edge portion of the substrate 1 with the wiping surface 12*a* facing the clean target surface 1*a*. The cleaning tape 12 that has passed through between the presser member 11*a* and the clean target surface 1*a* is looped, so that the wiping surface 12*b* faces the back side of the substrate 1. The looped cleaning tape 12 passes through between the presser member 11*b* and the clean target surface 1*b* in the same direction as with the passage between the presser member 11*a* and the clean target surface 1*a*, with the wiping surface 12*b* facing the clean target surface 1*b*. In this state, the substrate 1 is moved in the longitudinal direction of its edge portion, by which the cleaning tape 12 cleans the clean target surface 1*a* by the wiping surface 12*a* and, simultaneously with this, cleans the clean target surface 1*b* by the wiping surface 12*b*. As a result of this, the clean target surfaces 1*a*, 1*b* can be properly cleaned by the cleaning tape 12 without a 180° twisting of the cleaning tape 12. Also, since the two wiping surfaces 12*a*, 12*b* of the cleaning tape 12 are used, the consumption amount of the cleaning tape 12 is suppressed, that is, replacement frequency of the cleaning tape 12 can be reduced. As a result, the cleaning cost for the substrate 1 is reduced.

Also, as shown in FIGS. 1, 2, 6 and 7, the feeding reel 16, the cleaning tape driving device 17, the presser members 11*a*, 11*b*, the tape path forming member 18 (plural guide rollers 18*a*-18*h*), and the collecting reel are provided in the unit frame 22 to make up one cleaning unit 21. This cleaning unit 21, as shown in FIG. 7, is removably fitted on the main body 4*a* of the cleaning mechanism 4 provided on the base 5. Therefore, the cleaning unit 21 of which the cleaning tape has been exhausted and which is fitted on the main body 4*a* of the cleaning mechanism 4 is replaced with the cleaning unit 21 on which an unused cleaning tape 12 is set, by which the unused cleaning tape 12 can be set up on the cleaning mechanism 4 easily in short time.

Further, since the feeding reel 16 and the collecting reel 20 are set in parallel in a state that their rotational center lines are substantially coincident with each other, the substrate cleaning apparatus, particularly the cleaning unit 21, can be made more compact, compared with cases in which those rotational center lines are not substantially coincident with each other.

Furthermore, when the surface contamination of the wiping surface 12*b* of the cleaning tape 12 is partly more than a prescribed level, the part of surface contamination of more than prescribed level skips the portion between the presser member 11*b* and the clean target surface 1*b*. As a result of this, the part of the cleaning tape 12 where the surface contamination is more than the prescribed level is no longer used for the cleaning of the clean target surface 1*b*. Thus, occurrence of cleaning failures is suppressed.

In addition, when the number of times the cleaning tape 12 skips between the presser member 11*b* and the clean target surface 1*b* comes to a prescribed frequency or more, an alarm is issued for notification. As a result, the worker can know the occurrence of any trouble with the cleaning tape 12.

Further in addition, the presser member 11*a* presses the cleaning tape 12 against the clean target surface 1*a* and moreover the presser member 11*b* presses the cleaning tape 12 against the clean target surface 1*b*, by which the edge portion of the substrate 1 is pinched by the two presser member 11*a* and 11*b*, as viewed from another viewpoint. Therefore, it becomes no longer necessary for the substrate moving device 3 to support the edge portion of the substrate 1. That is, the substrate 1 is supported at its substantial central portion by the substrate moving device 3 and moreover its edge portion is supported by the two presser members 11*a*, 11*b*, thus the substrate 1 being supported in a stable posture. Thus, the substrate moving device 3 can be made more compact.

Further in addition, since the cleaning mechanism is so designed as to feed the cleaning tape 12 in a direction orthogonal to the moving direction of the substrate 1, i.e., since the cleaning mechanism 4 is provided in the cleaning unit 21 so that the radial directions of the two reels 16, 20 become orthogonal to the moving direction of the substrate 1, the substrate 1 is smaller and compact in its moving-direction size.

Further in addition, each of the presser members 11*a*, 11*b* includes the protrusion 13*a* in a counter surface (surface to make contact with the cleaning tape 12) 13 opposed to the substrate 1, and the protrusion 13*a* makes the cleaning tape 12 engaged therewith so that the cleaning tape 12 is prevented from being moved in the longitudinal direction of the edge portion along with the substrate 1. Thus, even if the moving speed of the substrate 1 is enhanced, the cleaning tape 12 is enabled to reliably clean the clean target surfaces of the side edge portion of the substrate 1.

Although the substrate cleaning apparatus according to the first embodiment of the invention has been described hereinabove, it is apparent for those skilled in the art that the substrate cleaning apparatus of this embodiment may be varied and changed in various ways as will be described later or otherwise.

As an example, as shown in FIG. 6, the drive cylinder 25 for driving the collecting reel 20 and the cleaning tape driving device 17 may be a motor. In this case, preferably, the motor drives the collecting reel 20 and the cleaning tape driving device 17 via gears or a belt. The motor is, preferably, a stepping motor capable of controlling its rotational amount.

Also, the direction in which the cleaning tape 12 passes through between the presser members 11*a*, 11*b* and the clean target surfaces 1*a*, 1*b* is a direction orthogonal to the longitudinal direction of the edge portion of the substrate 1 (moving direction of the substrate 1) in the above first embodiment as shown in FIG. 1 or 2. However, the direction may be different ones. For example, it is implementable to make up the substrate cleaning apparatus so that the cleaning tape 12 passes through between the presser members 11*a*, 11*b* and the clean target surfaces 1*a*, 1*b* in the longitudinal direction of the edge portion of the substrate 1.

Further, although the direction in which the cleaning tape 12 passes through between the presser member 11*a* and the clean target surface 1*a* and the direction in which the cleaning tape 12 passes through between the presser member 11*b* and the clean target surface 1*b* are identical to each other in the above first embodiment as shown in FIGS. 1 and 2, yet the these two passage directions may be different from each other. However, it is preferable that these two passage directions are identical to each other. The reason of this is that as shown in FIG. 2 as an example, for the cleaning tape 12 to be looped by the loop path 19, the moving direction of the cleaning tape 12 at the start of the loop and its moving direction at the end of the loop are generally identical to each other. Therefore, in order that the two passage directions are different from each other, there arises a need for another path that involves a generally 180° change of the cleaning-tape moving device after the loop path 19, resulting in an elongated tape path as a whole. As a result, the substrate cleaning apparatus, particularly the cleaning unit 21, would be increased in scale. Therefore, preferably, the two passage directions are set identical to each other, in which case the whole tape path including the loop path 19 can be made shorter, i.e., the cleaning unit 21 can be made more compact.

Further, although the cleaning of the clean target surface 1*a* by the wiping surface 12*a* of the cleaning tape 12 and the cleaning of the clean target surface 1*b* by the wiping surface 12*b* are carried out concurrently in the above first embodiment as shown in FIG. 5, yet the cleaning by the wiping surface 12*a* and the cleaning by the wiping surface 12*b* may be carried out non-concurrently. It is also allowable that only one wiping surface 12*a* of the cleaning tape 12 is used to clean the two clean target surfaces 1*a*, 1*b* and, after exhaustion of the one wiping surface 12*a*, the other wiping surface 12*b* is used to clean the two clean target surfaces 1*a*, 1*b*.

Figure 9:
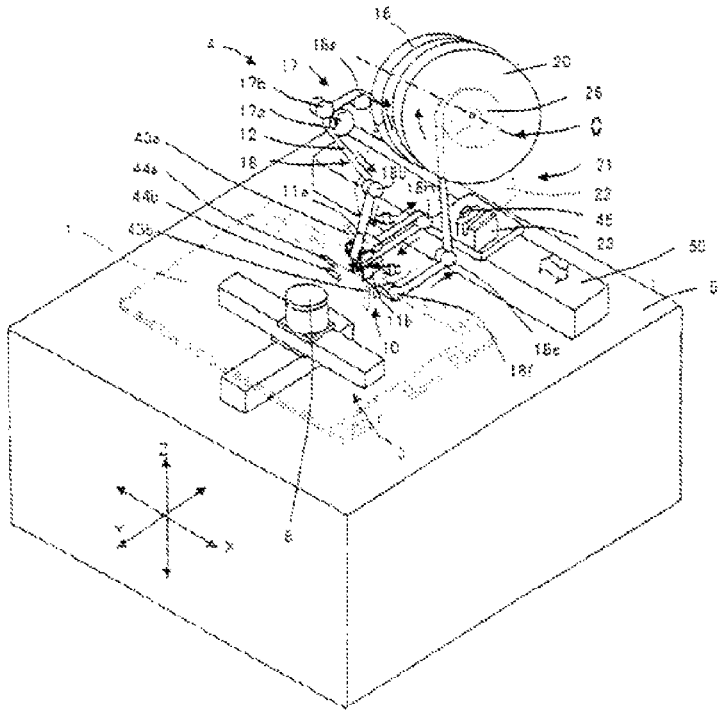
FIG. 9 is a schematic perspective view of a modification of the embodiment.

A substrate cleaning apparatus which is so modified as to fulfill the above arrangement is shown in FIG. 9. Hereinafter, in the description of substrate cleaning apparatuses different from the substrate cleaning apparatus of the first embodiment, the same component members as in the first embodiment are designated by the same reference signs. Also, different points from the substrate cleaning apparatus of the first embodiment will mainly be described below.

The substrate cleaning apparatus shown in FIG. 9 has a tape path which is so formed that the cleaning tape 12 passes through between the presser member 11*a* and the clean target surface positioned on the front side of the edge portion of the substrate 1, next turns back by the guide roller 18*h*, and then passes through between the presser member 11*b* and the clean target surface positioned on the back side of the edge portion. That is, the substrate cleaning apparatus is designed to clean the two clean target surfaces simultaneously by different parts of one wiping surface of the cleaning tape 12. Also, this substrate cleaning apparatus is so designed as to feed the cleaning tape in such a way that the wiping-surface part that has cleaned the front-side clean target surface of the edge portion of the substrate 1 skips between the presser member 11*b* and the back-side clean, target surface of the edge portion as in the case of the above first embodiment (the substrate cleaning apparatus is so designed that the same part of the wiping surface does not clean the two clean target surfaces).

This substrate cleaning apparatus is further so designed that the collecting reel 20, which winds up and collects the cleaning tape 12 with its one wiping surface only used, can be used as the feeding reel 16, and that after the one wiping surface only has been used for cleaning, the other wiping surface is used for cleaning.

For example, as shown in FIG. 9, the cleaning mechanism 4 is designed to drive the collecting reel 20 so that the collecting reel 20 winds up the cleaning tape 12 while the wiping surface used for cleaning is directed toward the reel center. The cleaning mechanism 4 is also so designed that the feeding reel 16 is supported so as to be freely rotatable in two directions. Further, the collecting reel 20 is so designed as to be usable as the feeding reel 16. As a result, the two wiping surfaces of the cleaning tape 12 can be used for cleaning by following the procedure shown below.

First, the collecting reel 20 winds up and collects the cleaning tape 12, of which one wiping surface has been used for cleaning, while its wiping surface that has been used for cleaning is directed toward the reel center. Next, the collecting reel 20 that has completed the collecting of the cleaning tape 12 is reversed and set as the feeding reel 16 in the cleaning mechanism 4. Subsequently, the cleaning tape 12 wound on the feeding reel 16 (collecting reel 20) is set in the tape path forming member 18 so that the unused wiping surface faces the front and back sides of the edge portion of the substrate 1.

Thus, the two clean target surfaces 1*a*, 1*b* can be cleaned by using only one wiping surface of the cleaning tape 12 and, after exhaustion of the one wiping surface 12*a*, the other wiping surface 12*b* can be used to clean the two clean target surfaces 1*a*, 1*b*.

Furthermore, although the substrate 1 is moved in the longitudinal direction of its edge portion during the cleaning in the above first embodiment as shown in FIG. 4, yet it is also allowable that the cleaning tape 12 is moved in the longitudinal direction of the edge portion of the substrate 1.

More specifically, as in the substrate cleaning apparatus shown in FIG. 9, a cleaning unit moving device 50 for moving the cleaning unit 21 in the longitudinal direction of the edge portion of the substrate 1 is provided in the substrate cleaning apparatus. By this cleaning unit moving device 50 moving the cleaning unit 21 in the longitudinal direction of the edge portion of the substrate 1, the cleaning tape 12 can be moved in the longitudinal direction of the edge portion. Preferably, the cleaning unit moving device 50 is so designed as to move the cleaning unit 21 to which a cleaning unit 21 is removably fitted. By replacement between one cleaning unit 21 on which unused cleaning tape 12 is set and another cleaning unit 21 whose cleaning tape has been exhausted and which is fitted to the cleaning unit moving device 50, it becomes possible to set up unused cleaning tape 12 on the cleaning mechanism 4 easily in short time.

In the case where the cleaning unit 21 is moved in the longitudinal direction of the edge portion of the substrate 1, the feeding reel 16 and the collecting reel 20 are preferably so juxtaposed that their rotational center lines are substantially coincident with each other as shown in FIG. 9.

Given as an example is a case where the rotational center lines of the two reels are substantially non-coincident with each other and, as viewed in the extending direction of the rotational center line (moving direction of the cleaning unit 21), a deeper-side reel is partly exposed from the outer periphery of the forward-side reel (the radius of the forward-side reel is equal to or larger than the radius of the deeper-side reel). In the case of this example, because of the presence of the exposed portion, the cleaning unit 21 becomes relatively larger, with the rigidity relatively lower, compared with the case where the deeper-side reel is fully hidden by the forward-side reel with their rotational center lines substantially coincident with each other. Also, the reels and the members supporting the reels are more likely to swing during the move of the cleaning unit 21, so that, for example, vibrations are more likely to occur. As a result, it becomes difficult to move the cleaning unit 21 at high speed.

The cleaning unit 21 is moved by the cleaning unit moving device 50 in the longitudinal direction of the edge portion of the substrate 1, and the feeding reel 16 and the collecting reel 20 are provided in the cleaning unit 21 in a state that their rotational center lines are substantially coincident with each other. As a result of this, there can be realized a compact cleaning unit 21 which can be moved at high speed, e.g., at a speed of 300 to 500 mm/s in the longitudinal direction of the edge portion of the substrate 1. Also, the cleaning unit 21, by virtue of its compact makeup, is lightweight and high in rigidity and therefore enabled to smoothly move by suppressing occurrence of vibrations during the high-speed move. Also because of such makeup, the cleaning unit 21 does not need large energy for its start-up, acceleration, deceleration and stop. That is, the cleaning unit moving device 50 can also be made compact in structure.

In addition, with a view to moving the cleaning unit 21 at high speed in the longitudinal direction of the edge portion of the substrate 1 to shorten the cleaning time and, as a result, suppressing the cleaning cost, the tape path for the cleaning tape 12 is preferably a simple path having a short tape path. With a simple tape path, the number of tape path forming members 18, i.e., the number of guide rollers becomes smaller, so that the cleaning unit 21 can be made lightweight.

As an example, there can be mentioned a tape path shown in FIG. 9 as a simple tape path which allows the cleaning unit 21 to be moved at high speed. The tape path shown in FIG. 9 is so formed that the cleaning tape 12 passes through between the presser member 11*a* and the clean target surface positioned on the front side of the edge portion of the substrate 1, next turns back by the guide roller 18*h* and subsequently passes through between the presser member 11*b* and the clean target surface positioned on the back side of the edge portion (the tape path is formed so as to clean the two clean target surfaces concurrently by different parts of one wiping surface of the cleaning tape 12). According to the simple tape path shown in FIG. 9, the cleaning unit 21 is lighter in weight, enabled to move at high speed.

With large-scale substrates, such a cleaning unit 21 allows the large-scale substrate to be cleaned in short time without using any large-scale substrate moving device for moving the substrate in the longitudinal direction of its edge portion. As a result, the cleaning cost for large-scale substrates is suppressed.

Furthermore, it is also allowable that both the substrate 1 and the cleaning tape 12 are moved relative to each other in the longitudinal direction of the edge portion of the substrate.

In this case, the substrate cleaning apparatus has both the substrate moving device 3 and the cleaning unit moving device 50 shown in FIG. 9. The substrate moving device 3 moves the substrate 1 toward one side of the longitudinal direction, while the cleaning unit moving device 50 moves the cleaning unit 21 toward the other side of the longitudinal direction, thus making it possible to fulfill the cleaning at higher speed.

Second Embodiment

Figure 10:
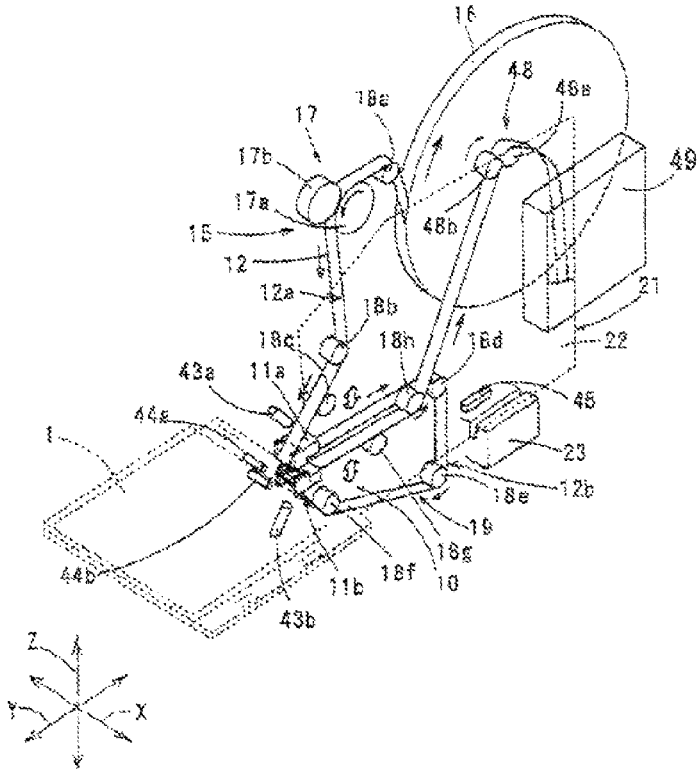
FIG. 10 is a schematic perspective view of a substrate cleaning apparatus according to a second embodiment of the invention.

Next, a substrate cleaning apparatus according to a second embodiment of the invention will be described with reference to FIG. 10.

The substrate cleaning apparatus of the first embodiment collects the cleaning tape 12 by winding the tape by the collecting reel 20. In contrast to this, as shown in FIG. 10, the substrate cleaning apparatus of this embodiment has, instead of the collecting reel 20, a cleaning tape collecting device 48 for collecting the cleaning tape 12, and a collecting box 49 for accommodating the cleaning tape 12 collected by the cleaning tape collecting device 48.

The cleaning tape collecting device 48 has a collecting roller 48*a* for pulling up the cleaning tape 12, and a pinch roller 48*b* for pressing the cleaning tape 12 against the collecting roller 48*a*. The collecting roller 48*a* and the pinch roller 48*b* are provided on the unit frame 22 of the cleaning unit 21 (incorporated in the cleaning unit 21). Also, the collecting roller 48*a* is so designed as to rotate in synchronization with the drive roller 17*a*.

The collecting box 49 is removably fitted on the main body 4*a* of the cleaning mechanism 4.]

According to this embodiment, the cleaning tape 12 can be collected without using the collecting reel 20.

Third Embodiment

A substrate cleaning apparatus according to a third embodiment of the invention will be described with reference to FIG. 11.

In the above-described substrate cleaning apparatus according to the first embodiment, as shown in FIG. 1 or 1, by the tape path forming member 18, the cleaning tape 12 is passed through between the presser member 11*a* and the clean target surface 1*a* and thereafter looped within the space between the substrate 1 and the feeding reel 16. In contrast to this, in the substrate cleaning apparatus of this embodiment, the cleaning tape 12 that has passed through between the presser member 11*a* and the clean target surface 1*a* is looped along the periphery (radial outside) of the feeding reel 16 by the tape path forming member 18 (plural guide rollers 18*a*-18*h*).

Figure 11:
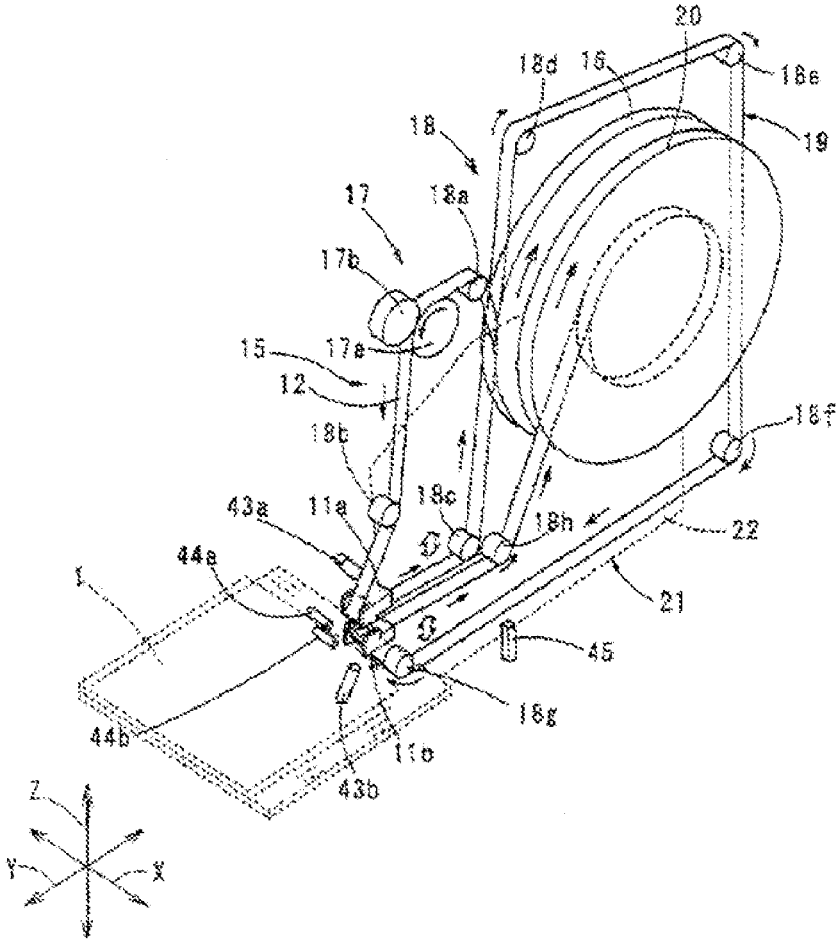
FIG. 11 is a schematic perspective view of a substrate cleaning apparatus according to a third embodiment of the invention.

According to this embodiment, as apparent from comparison between FIG. 2 and FIG. 11, a distance from between the presser member 11*a* and the clean target surface 1*a* to the guide roller 18*d* is longer than that of the first embodiment. As a result of this, the cleaner sufficiently volatilize from the cleaning tape 12 before the cleaning tape 12 that has cleaned the clean target surface 1*a* by the wiping surface 12*a* reaches the guide roller 18*d*. Thus, surface contamination of the wiping surface 12*a* of the cleaning tape 12 is inhibited from being transferred to the guide rollers 18*d*-18*g* together with the cleaner.

Fourth Embodiment

A substrate cleaning apparatus according to a fourth embodiment of the invention will be described with reference to FIG. 12. This embodiment has similarity to the third embodiment.

In the substrate cleaning apparatus of the third embodiment, as shown in FIG. 11, the cleaning tape 12 passes through between the presser member 11*a* and the clean target surface 1*a* in a direction approaching the collecting reel 20, and also through between the presser member 11*b* and the clean target surface 1*b* in a direction approaching the collecting reel 20. In contrast to this, in the substrate cleaning apparatus of this embodiment, as shown in FIG. 12, the cleaning tape 12 passes through between the presser member 11*a* and the clean target surface 1*a* in a direction increasingly away from the collecting reel 20, and also passes through between the presser member 11*b* and the clean target surface 1*b* in a direction increasingly away from the collecting reel 20.

Figure 12:
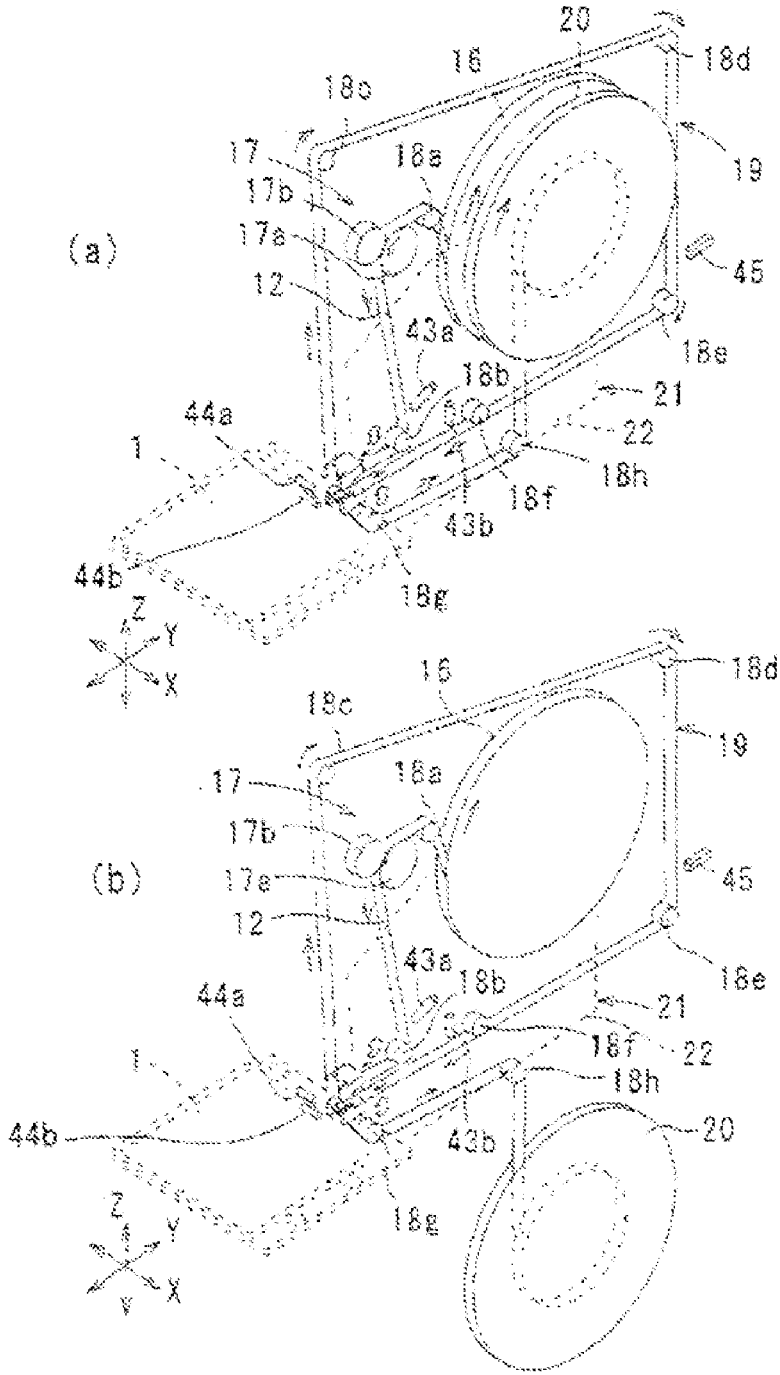
FIG. 12(*a*) is a schematic perspective view of a substrate cleaning apparatus according to a fourth embodiment of the invention.
Figure 13:
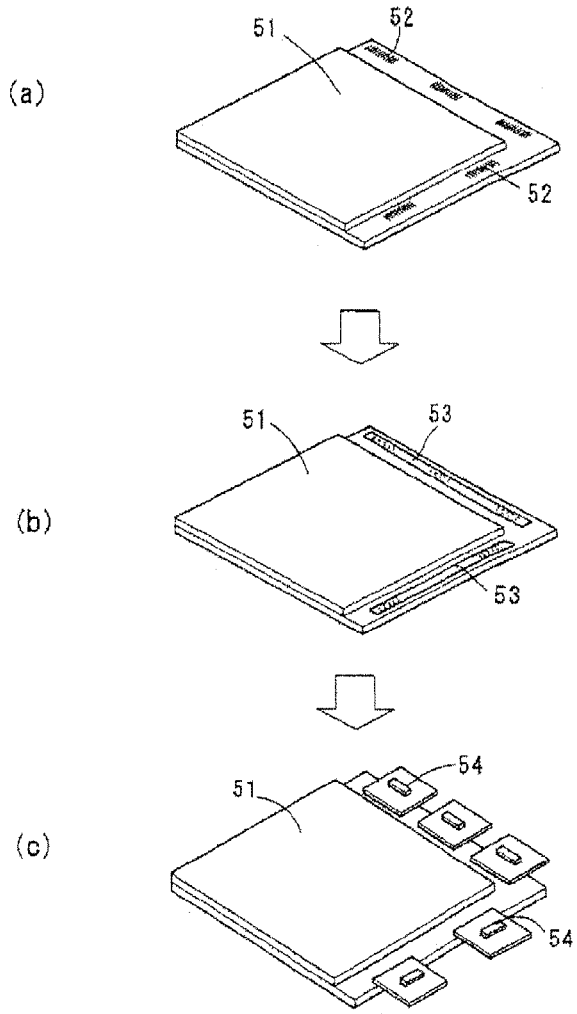
FIGS. 13(*a*), 13(*b*), and 13(*c*) are views for explaining component mounted to a glass substrate; according to a conventional art.
Figure 14:
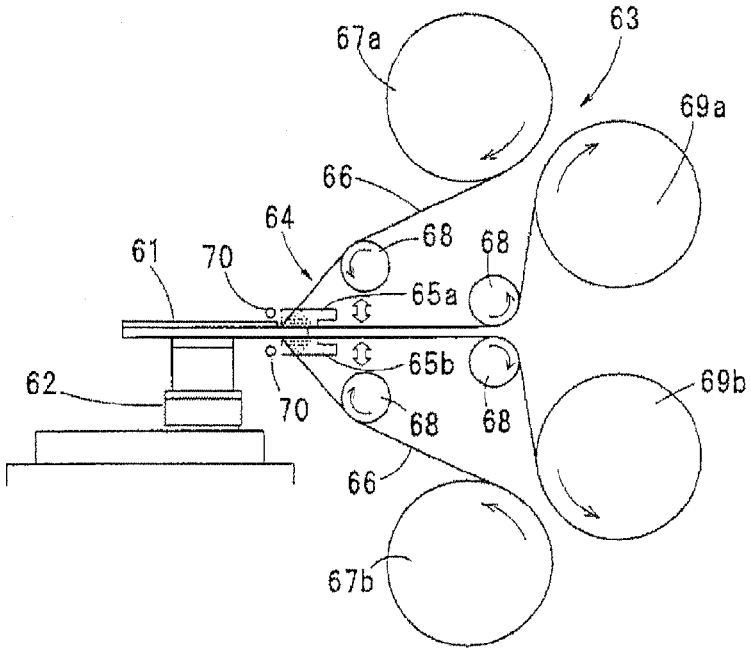
FIG. 14 is a schematic side view of a substrate cleaning apparatus according to a conventional art.

FIG. 12(*a*) shows an example in which the feeding reel 16 and the collecting reel 20 are juxtaposed so that their rotational center lines are substantially coincident with each other. FIG. 12(*b*) shows an example in which the feeding reel 16 and the collecting reel 20 are placed substantially on one same plane.

According to this embodiment, as shown in FIG. 12, the guide rollers 18*c*-18*f* forming the loop path 19 are enabled to guide and loop the cleaning tape 12 without contact with the wiping surface 12*a* that has cleaned the clean target surface 1*a* and so attached with surface contamination. As a result of this, surface contamination of the plural guide rollers 18*c*-18*f* can be suppressed.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The entire disclosure of Japanese Patent Application No. 2008-282313 filed on Oct. 31, 2008, and a priority claim application based on this application, Japanese Patent Application No. 2009-179099 filed on Jul. 31, 2009, including specification, claims, drawings, and summary are incorporated herein by reference in its entirety.

It is apparent that the present invention is capable of cleaning clean target surfaces positioned on front and back sides of not only the edge portion but also other part of a substrate by two wiping surfaces of cleaning tape, properly and at high speed. Therefore, the present invention is suitably applicable to fields involving cleaning of substrates, such as component mounting for mounting component parts onto the substrate.

The invention claimed is:

1. A substrate cleaning apparatus for cleaning a first clean target surface positioned on a front side of an edge portion of a substrate and a second clean target surface positioned on a back side of the edge portion of the substrate by a fabric cleaning tape including a first wiping surface and a second wiping surface, the substrate cleaning apparatus comprising:

a first presser member for pressing the cleaning tape against the first clean target surface;

a second presser member for pressing the cleaning tape against the second clean target surface;

a tape path forming member which forms a tape path for the cleaning tape, the tape path passing through between the first presser member and the first clean target surface and between the second presser member and the second clean target surface;

a tape feeding device which feeds the cleaning tape to the tape path;

a tape collecting device which collects the cleaning tape from the tape path;

a tape driving device which drives the cleaning tape;

a cleaner discharging device which discharges a cleaner to the cleaning tape; and a moving device for moving the cleaning tape and the substrate relative to each other in a longitudinal direction of the edge portion of the substrate, wherein the tape path includes:

a first path which allows the cleaning tape to pass through between the first presser member and the first clean target surface in a direction orthogonal to the longitudinal direction of the edge portion of the substrate with the first wiping surface facing the first clean target surface;

a second path which allows the cleaning tape, which has passed through the first path, to be looped so that the second wiping surface faces the back side of the substrate; and a third path which allows the cleaning tape, which has passed through the second path, to pass through between the second presser member and the second clean target surface in a direction identical to the passage direction of the cleaning tape in the first path with the second wiping surface facing the second clean target surface.

2. The substrate cleaning apparatus according to claim 1, wherein the tape path forming member forms the tape path so as to further include a fourth or fifth path, the fourth path which allows the cleaning tape, which has passed through the third path, to bypass the second path by passing beside a widthwise direction of the cleaning tape of the second path, and to reach the tape collecting device, the fifth path which allows the cleaning tape, which has passed from the tape feeding device, to bypass the second path by passing beside the widthwise direction of the cleaning tape of the second path, and to reach the first path.

3. The substrate cleaning apparatus according to claim 1, further comprising:

a cleaning unit which includes at least the tape feeding device, the first and second presser members, and the tape path forming member, and which is removably fitted to a main body of the substrate cleaning apparatus; and a driving device for driving the tape feeding device, and a driving device for driving the first and second presser members, the driving devices being provided on the main body of the substrate cleaning apparatus.

4. The substrate cleaning apparatus according to claim 1, wherein the second path is formed by the tape path forming member so that the cleaning tape is looped along a periphery of the tape feeding device.

5. The substrate cleaning apparatus according to claim 1, wherein the first path is formed by the tape path forming member so that the cleaning tape passes through between the first presser member and the first clean target surface in a direction increasingly away from the tape feeding device, the second path is formed by the tape path forming member so that the cleaning tape that has passed through the first path is looped along the periphery of the tape feeding device, and the third path is formed by the tape path forming member so that the cleaning tape passes in a direction identical to a passage direction of the cleaning tape in the first path.

6. The substrate cleaning apparatus according to claim 1, further comprising:

a control device for controlling a feed amount of the cleaning tape by the tape driving device; and a surface contamination detecting device for detecting a surface contamination of the second wiping surface of the cleaning tape after passing through between the first presser member and the first clean target surface, wherein the control device controls the feed amount of the cleaning tape so that a part of the second wiping surface where more than a prescribed level of surface contamination has been detected by the surface contamination detecting device skips between the second presser member and the second clean target surface.

7. The substrate cleaning apparatus according to claim 6, wherein an alarm is issued when skip execution frequency by the control device becomes a prescribed frequency or more.

8. A substrate cleaning apparatus for cleaning a first clean target surface positioned on a front side of an edge portion of a substrate and a second clean target surface positioned on a back side of the edge portion of the substrate by a fabric cleaning tape including a first wiping surface and a second wiping surface, the substrate cleaning apparatus comprising:

a first presser member for pressing the cleaning tape against the first clean target surface;

a second presser member for pressing the cleaning tape against the second clean target surface;

a tape path forming member which forms a tape path for the cleaning tape, the tape path passing through between the first presser member and the first clean target surface and between the second presser member and the second clean target surface;

a tape feeding device which feeds the cleaning tape to the tape path;

a tape collecting device which collects the cleaning tape from the tape path;

a tape driving device which drives the cleaning tape;

a cleaner discharging device which discharges a cleaner to the cleaning tape; and a moving device for moving the cleaning tape and the substrate relative to each other in a longitudinal direction of the edge portion of the substrate, wherein the tape path includes:

a first path which allows the cleaning tape to pass through between the first presser member and the first clean target surface in a direction orthogonal to the longitudinal direction of the edge portion of the substrate with the first wiping surface facing the first clean target surface;

a second path which allows the cleaning tape, which has passed through the first path, to be looped so that the second wiping surface faces the back side of the substrate; and a third path which allows the cleaning tape, which has passed through the second path, to pass through between the second presser member and the second clean target surface with the second wiping surface facing the second clean target surface, and wherein the tape feeding device has a feeding reel on which the cleaning tape is wound, the tape collecting device has a collecting reel for winding up and collecting the cleaning tape, and the feeding reel and the collecting reel are juxtaposed in parallel.

9. The substrate cleaning apparatus according to claim 8, wherein the third path is so formed that the tape path forming member allows the cleaning tape to pass through in a direction identical to a passage direction of the cleaning tape in the first path.

10. The substrate cleaning apparatus according to claim 8, wherein the tape path forming member forms the tape path so as to further include a fourth or fifth path, the fourth path which allows the cleaning tape, which has passed through the third path, to bypass the second path by passing beside a widthwise direction of the cleaning tape of the second path, and to reach the tape collecting device, the fifth path which allows the cleaning tape, which has passed from the tape feeding device, to bypass the second path by passing beside the widthwise direction of the cleaning tape of the second path, and to reach the first path.

11. The substrate cleaning apparatus according to claim 8, further comprising:

a cleaning unit which includes at least the tape feeding device, the first and second presser members, and the tape path forming member, and which is removably fitted to a main body of the substrate cleaning apparatus; and a driving device for driving the tape feeding device, and a driving device for driving the first and second presser members, the driving devices being provided on the main body of the substrate cleaning apparatus.

12. The substrate cleaning apparatus according to claim 8, wherein the second path is formed by the tape path forming member so that the cleaning tape is looped along a periphery of the tape feeding device.

13. The substrate cleaning apparatus according to claim 8, wherein the first path is formed by the tape path forming member so that the cleaning tape passes through between the first presser member and the first clean target surface in a direction increasingly away from the tape feeding device, the second path is formed by the tape path forming member so that the cleaning tape that has passed through the first path is looped along the periphery of the tape feeding device, and the third path is formed by the tape path forming member so that the cleaning tape passes in a direction identical to a passage direction of the cleaning tape in the first path.

14. The substrate cleaning apparatus according to claim 8, further comprising:

a control device for controlling a feed amount of the cleaning tape by the tape driving device; and a surface contamination detecting device for detecting a surface contamination of the second wiping surface of the cleaning tape after passing through between the first presser member and the first clean target surface, wherein the control device controls the feed amount of the cleaning tape so that a part of the second wiping surface where more than a prescribed level of surface contamination has been detected by the surface contamination detecting device skips between the second presser member and the second clean target surface.

15. The substrate cleaning apparatus according to claim 9, wherein the tape path forming member forms the tape path so as to further include a fourth or fifth path, the fourth path which allows the cleaning tape, which has passed through the third path, to bypass the second path by passing beside a widthwise direction of the cleaning tape of the second path, and to reach the tape collecting device, the fifth path which allows the cleaning tape, which has passed from the tape feeding device, to bypass the second path by passing beside the widthwise direction of the cleaning tape of the second path, and to reach the first path.

16. The substrate cleaning apparatus according to claim 9, further comprising:

a cleaning unit which includes at least a the tape feeding device, the first and second presser members, and the tape path forming member, and which is removably fitted to a main body of the substrate cleaning apparatus; and a driving device for driving the tape feeding device, and a driving device for driving the first and second presser members, the driving devices being provided on the main body of the substrate cleaning apparatus.

17. The substrate cleaning apparatus according to claim 9, wherein the second path is formed by the tape path forming member so that the cleaning tape is looped along a periphery of the tape feeding device.

18. The substrate cleaning apparatus according to claim 9, wherein the first path is formed by the tape path forming member so that the cleaning tape passes through between the first presser member and the first clean target surface in a direction increasingly away from the tape feeding device, the second path is formed by the tape path forming member so that the cleaning tape that has passed through the first path is looped along the periphery of the tape feeding device, and the third path is formed by the tape path forming member so that the cleaning tape passes in a direction identical to a passage direction of the cleaning tape in the first path.

19. The substrate cleaning apparatus according to claim 9, further comprising:

a control device for controlling a feed amount of the cleaning tape by the tape driving device; and a surface contamination detecting device for detecting a surface contamination of the second wiping surface of the cleaning tape after passing through between the first presser member and the first clean target surface, wherein the control device controls the feed amount of the cleaning tape so that a part of the second wiping surface where more than a prescribed level of surface contamination has been detected by the surface contamination detecting device skips between the second presser member and the second clean target surface.

20. A substrate cleaning method for cleaning a first clean target surface positioned on a front side of an edge portion of a substrate and a second clean target surface positioned on a back side of the edge portion of the substrate by a fabric cleaning tape which includes a first wiping surface and a second wiping surface and which is impregnated with a cleaner, the substrate cleaning method comprising:

cleaning the first and second clean target surfaces by moving the cleaning tape and the substrate relative to each other in a longitudinal direction of the edge portion of the substrate while the cleaning tape is pressed against the first clean target surface by the first presser member and moreover the cleaning tape is pressed against the second clean target surface by the second presser member; and driving the cleaning tape in such a way that:

the cleaning tape passes through between the first presser member and the first clean target surface in a direction orthogonal to the longitudinal direction of the edge portion of the substrate with the first wiping surface facing the first clean target surface of the substrate, next, the cleaning tape is looped so that the second wiping surface faces the back side of the substrate; and subsequently, the cleaning tape passes through between the second presser member and the second clean target surface in a direction identical to the passage direction of the cleaning tape between the first presser member and the first clean target surface with the second wiping surface facing the second clean target surface.

* * * * *